United States Patent [19]

Genevey

[11] Patent Number: 4,850,929

[45] Date of Patent: Jul. 25, 1989

[54] TOY VEHICLE WITH PIVOTING AXLE

[75] Inventor: Raymond Genevey, Décines, France

[73] Assignee: Société Majorette, Caluire, France

[21] Appl. No.: 133,917

[22] Filed: Dec. 16, 1987

[30] Foreign Application Priority Data

Jan. 9, 1987 [FR] France ..... 87 00298

[51] Int. Cl.[4] ..... A63H 17/267

[52] U.S. Cl. ..... 446/466; 446/469; 280/43

[58] Field of Search ..... 446/469, 466, 465; 280/43, 47; 180/209

[56] References Cited

U.S. PATENT DOCUMENTS

| | | | |
|---|---|---|---|
| 399,389 | 3/1889 | Dunn et al. | 280/43 |
| 517,616 | 4/1894 | Lindner | 446/469 X |
| 4,696,655 | 9/1987 | D'Andrade et al. | 446/469 X |

FOREIGN PATENT DOCUMENTS

| | | | |
|---|---|---|---|
| 1085078 | 7/1960 | Fed. Rep. of Germany . | |
| 1244587 | 9/1960 | France . | |
| 155009 | 7/1986 | Japan | 280/43 |
| 1390068 | 4/1975 | United Kingdom . | |
| 2164263 | 3/1986 | United Kingdom . | |

*Primary Examiner*—Mickey Yu

*Attorney, Agent, or Firm*—Dowell & Dowell

[57] ABSTRACT

A toy vehicle with pivotal axle wherein the axle is made in the form of a stirrup having two spaced bearings for a supporting shaft upon which the wheels of the vehicle are mounted and in which the stirrup is selectively seated within a notch or slot made in lugs depending from the vehicle chassis with the stirrup being retained against the walls defining the notch or slot by a yieldable retaining member which also depends from the chassis thereby the axle and vehicle wheels may be vertically adjusted relative to the chassis.

10 Claims, 5 Drawing Sheets

TOY VEHICLE WITH PIVOTING AXLE

BACKGROUND OF THE INVENTION

1. FIELD OF THE INVENTION

The present invention relates to toy vehicles with rigid axles and to means for mounting each of them so that they may be retained at several positions with respect to the vehicle chassis.

2. HISTORY OF THE RELATED ART

Toy vehicles comprising four wheels of which the dimensions are disproportionate with respect to the bodywork are known to be very much in fashion at the present time. Such wheels are mounted at the end of a rigid axle supported by vertical lugs depending from the chassis of the toy in question. The wheels therefore have a determined position which is invariable with respect to the chassis.

SUMMARY OF THE INVENTION

The improvements according to the present invention aim at improving production of a toy vehicle of the type discussed above whose axles may take several positions so as to ensure different positions of the bodywork with respect to the ground.

In accordance with the invention, each axle of a toy vehicle is in the form of two spaced bosses which constitute bearing for a shaft of which the ends each bear a wheel, these bosses being part of a stirrup-shaped element whose lateral arms and transverse web cooperate with notches made in lugs formed with the chassis so that, under the effect of an elastic element abutting against the stirrup, the stirrup is retained against at least certain of the faces of the notches thereby to determining the different possible positions of the stirrup.

In a preferred embodiment of the above arrangement, each notch takes the form of a hollow Y, of which the vertical leg receives the transverse bar of the axle which is then oriented in median position corresponding to the greatest elevation of the toy vehicle with respect to the ground.

The two oblique faces of the notch constitute support for the underneath of the transverse bar and for the top of the lateral arms of the stirrup, the wheels at that moment being closer to the bodywork of the toy vehicle, but the spacing of the two axles being either increased or decreased.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
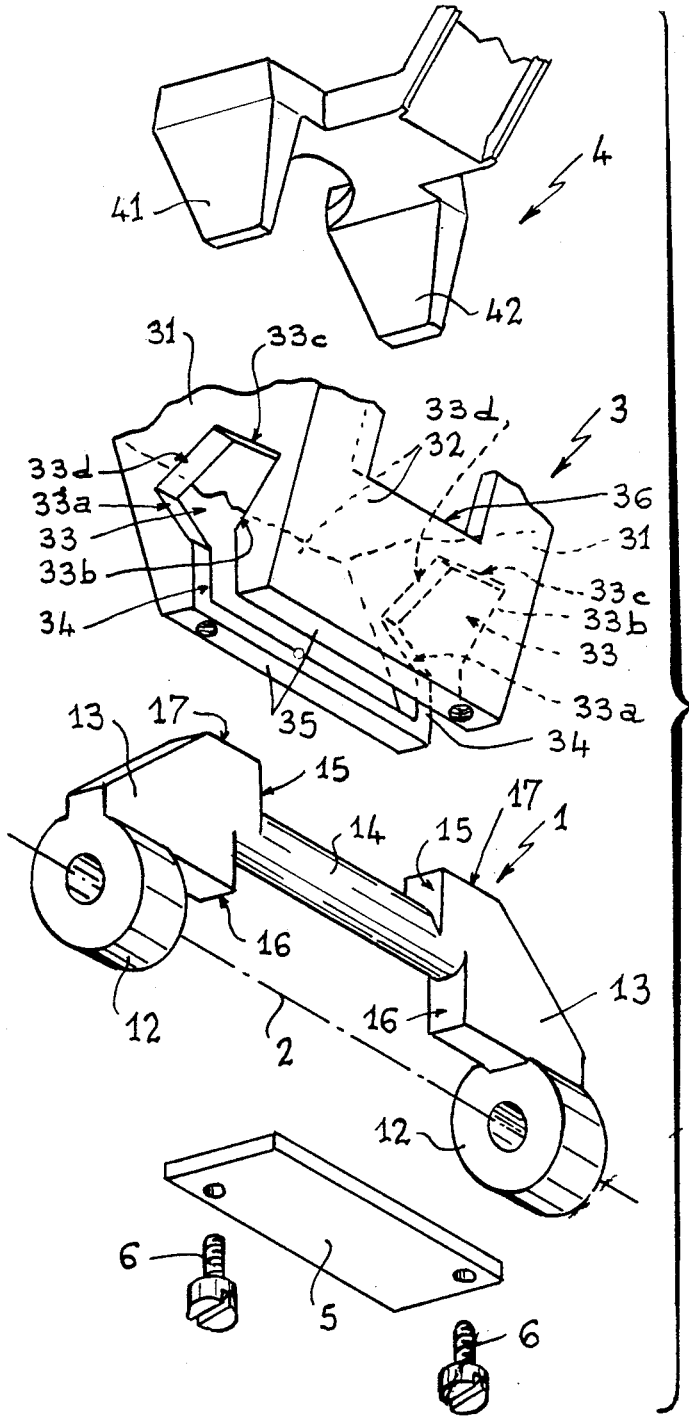
FIG. 1 is an exploded view in perspective of the different elements of a toy vehicle axle according to the invention and of the lugs of its chassis with which the stirrup-shaped element of the axle cooperates.

Referring now to the drawings, the axle of a toy vehicle according to the invention essentially comprises a stirrup-shaped element 1, retaining a wheel axle illustrated by a discontinuous line referenced 2 and which cooperates with a box element 3 disposed beneath the chassis 7 of a toy vehicle, as well as an elastic blade element 4 extending from the chassis which abuts on the stirrup 1 as will be explained in greater detail hereinbelow.

The stirrup 1 is composed of two cylindrical bosses 12 remote from each other, in whch the shaft 2 rotates and which are each formed with a bead 13 so that, with the latter, they each form the lateral arm of the U-shaped stirrup 1. This stirrup also comprises a transverse bar 14 connecting the two beads 13. The opposite faces of the two beads which project on either side of the bar, are stepped to form, on the one hand, two upper side walls 15 located beyond the bar and, on the other hand, two other vertical lower side walls 16 which are spaced apart further than the upper side walls 15 and located within the bar. The arms of the stirrup lie in a mean plane which contains this bar and the shaft 2.

The box element 3 is composed of two lugs 31 integral with the underneath of the chassis 7 of the toy vehicle and which are joined by transverse partitions 32. In each lug 31 is formed a notch 33 in the form of a vertical-axis diamond and which is extended by a slot 34 opening out on the lower face of each lug 31. It will be observed that the box element 3 further comprises two strips 35 which form a slotted bottom in the median part to allow introduction of the stirrup 1 into the box element 3. The box element 3 further comprises a cut-out 36 allowing passage of a yieldable retention blade 4. This blade comprises at its end two vertical fingers 41, 42 abutting against the stirrup 1.

When the stirrup is engaged in the notches 33, the bottom of the box element 3 is closed by a plate 5 fixed to the base of the box element by two screws 6.

In this way, notch 33 presents the general form of a hollow Y surmounted by two divergent faces.

The distance between upper side walls 15 of the bead 13 is slightly less than the distance separating the inner walls of the two lugs 31, whilst the distance between lower side walls 16 is equal, to within the clearance, to the distance separating the outer walls of the lugs 31.

Figure 2:
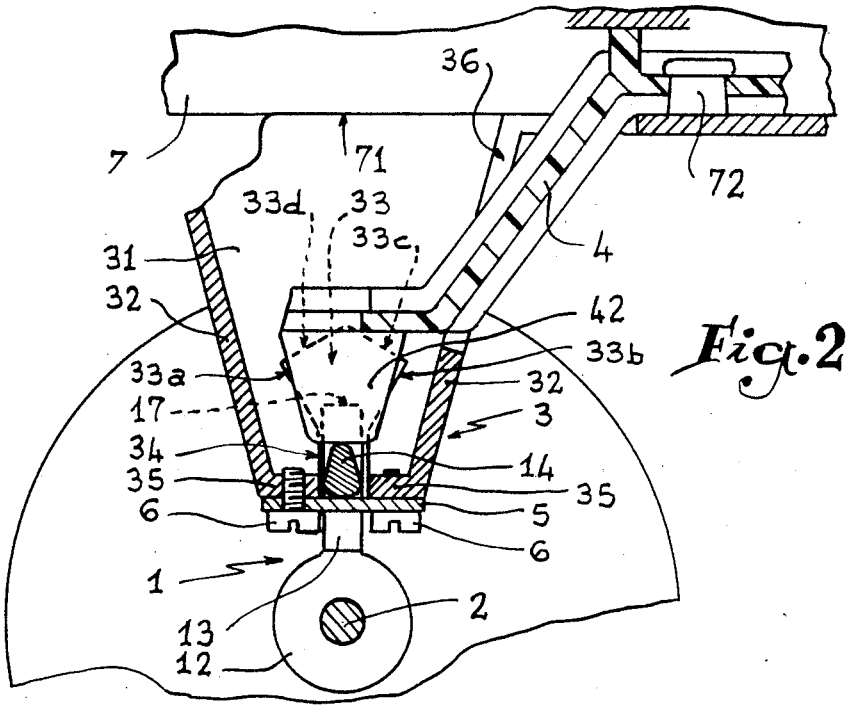
FIG. 2 is an enlarged transverse section of the axle 2 when in the position shown in FIG. 5.
Figure 3:
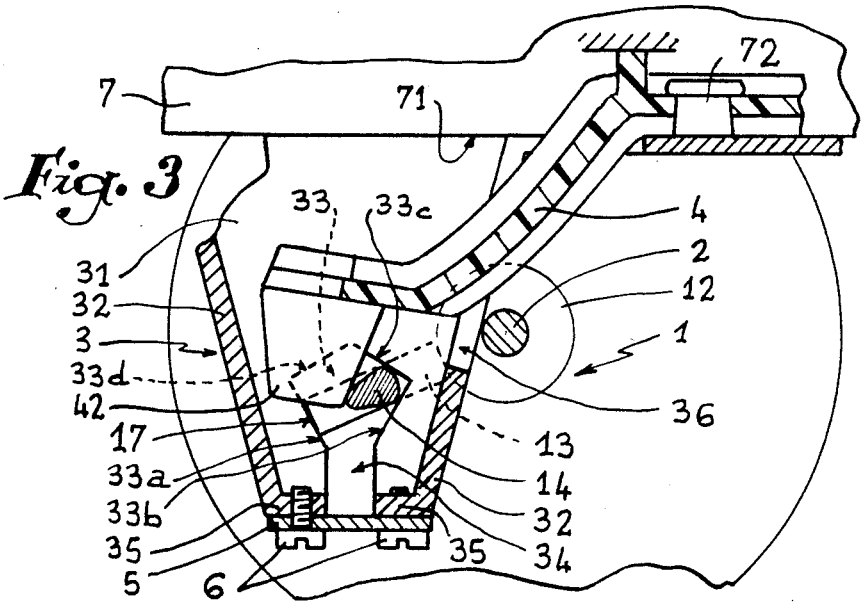
FIG. 3 is an enlarged transverse section of the axle 2 when in the position shown in FIG. 6.
Figure 4:
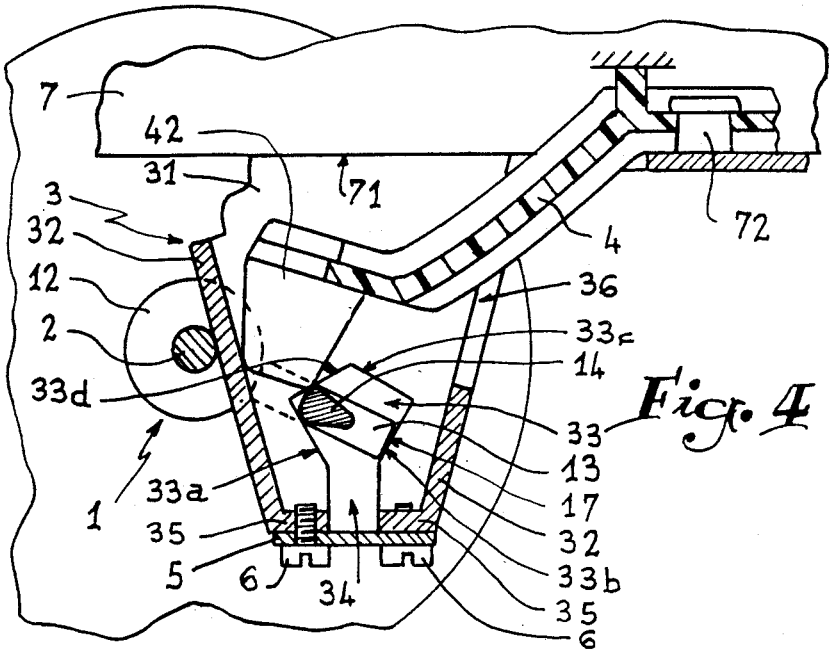
FIG. 4 is an enlarged transverse section of the axle 2 when in the position shown in FIG. 7.

Once the bar 14 of the stirrup 1 is engaged in the notch 33, the plate 5 is placed as illustrated in FIGS. 2 to 4 to close the base of the slot 34. The axle is thus captive in the slot which obviously includes the notches 33.

If it is desired that the wheel shaft 2 lie in median position with respect to the box element 3, the stirrup 1 is oriented vertically so that the bar 14 of the stirrup engages in the notch 33 and bears against the plate 5 while being maintained in abutment thereagainst by the elastic blade 4. At that moment, the lower side walls 16 of the two beads 13 cooperate with the outer wall of the two lugs 31 so that the stirrup is maintained transversely with respect to each box element 3 (FIG. 2).

Figure 5:
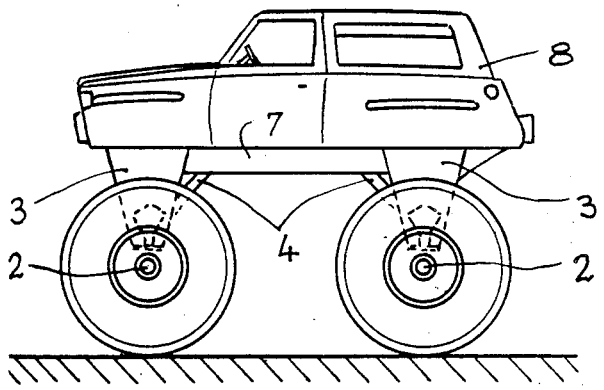
FIGS. 5 to 7 illustrate certain of the positions of the wheels of a toy vehicle provided with axles according to the invention, respectively oriented in the positions shown in FIGS. 2 to 4.

It is observed in FIG. 2 that the elastic blade 4 is associated with the lower face 71 of the chassis 7 of the toy vehicle whose bodywork has been referenced 8 (see FIG. 5). In the example shown, the elastic blade which is made of an appropriate plastics material, is elastically clipped around one or more headed studs 72.

If it is desired to pivot the wheel shaft 2 towards the right in FIG. 3, it suffices to press on this shaft or on the wheels to extract the bar 14 from the slot 34 and place it in notch 33, then pivot the wheels in the direction specified. At that moment, the top 17 of each bead 13 abuts against the left-hand face 33*a* of the notch 33, while the underside of the transverse bar 14 comes into abutment on the one hand against the face 33*b* symmetrical to face 33*a* and, on the other hand, against face 33*c* adjacent face 33*b*. There again, the fingers 41, 42 of the elastic blade 4 maintain the relevant parts of the stirrup against the faces of the notch 33. So as to obtain a greater stability, in the relevant position of the stirrup, the shaft 2 is arranged to abut against the corresponding transverse face 32 of the box element 3.

The position illustrated in FIG. 4 is strictly symmetrical to that of FIG. 3. The top 17 of each of the beads 13 comes into abutment against a face 33*b*, while the top of bar 14 is wedged between faces 33*a* and faces 33*d* which are adjacent thereto.

Figure 6:
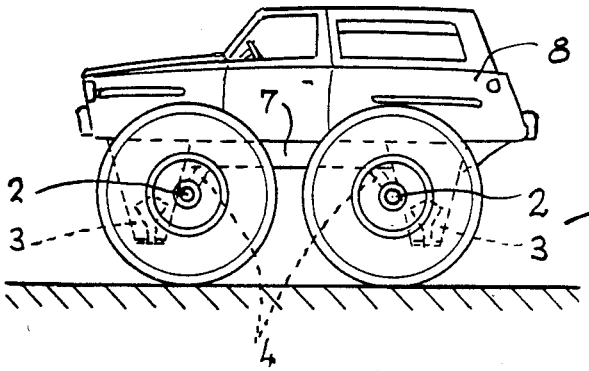
Figure 7:
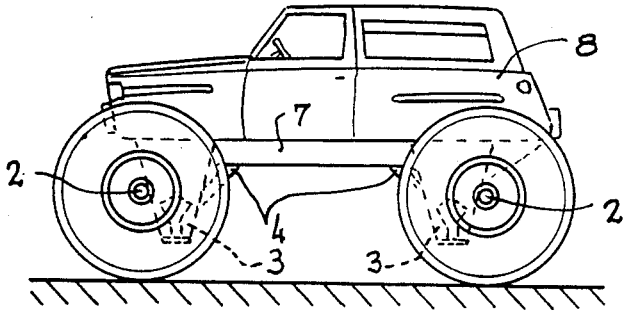

FIGS. 5 to 7 illustrate the positions of the bodywork 8 of the toy vehicle in the three positions of the axles described hereinabove. In FIG. 5, the bodywork is very high above the ground, the wheels being in the axis of the box elements; in FIG. 6, the wheels are closer to one another, as the axles are pivoted inwardly, while in FIG. 7, the wheel base is large since the two axles are pivoted outwardly.

Figure 8:
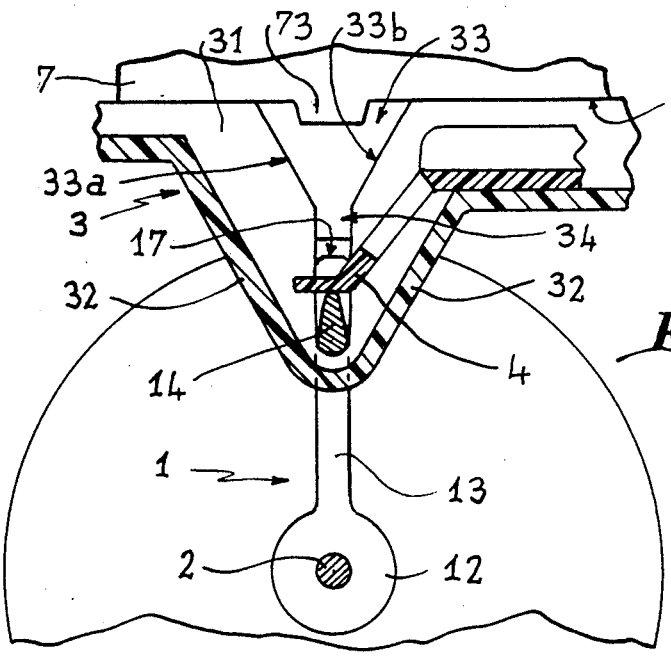
FIG. 8 is an enlarged transverse section of an alternate embodiment for supporting the axle relative to the vehicle so as to elevate the chassis of the vehicle to a position as shown in FIG. 5.
Figure 9:
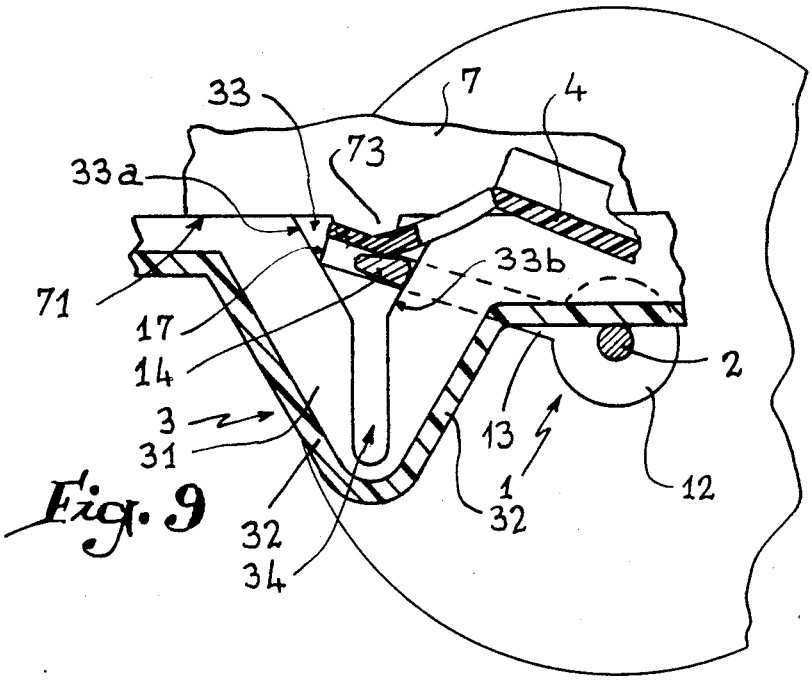
FIG. 9 is an enlarged transverse section of an alternate embodiment for supporting the axle so as to elevate the chassis of the vehicle to a position as shown in FIG. 6.
Figure 10:
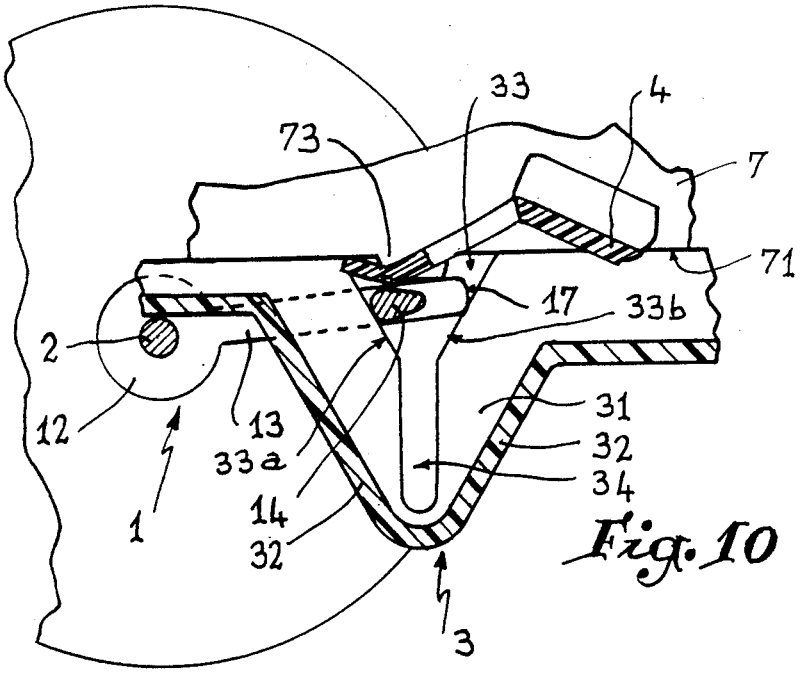
FIG. 10 is an enlarged transverse section of an alternate embodiment for supporting the axle so as to elevate the chassis of the vehicle to a position as shown in FIG. 7.

According to another embodiment illustrated in FIGS. 8 to 10, the notches 33 open out on the top of the lugs 31, with the result that the faces 33*c*, 33*d* provided in the embodiment of FIGS. 2 to 4, are eliminated.

In that case, in order to wedge the bar 14 against faces 33*a*, 33*b*, a stop 73 on chassis 7 is provided, which abuts against the bar in the positions of the shaft 2 pivoted towards the right or left, as shown in FIGS. 9 and 10. The top 17 of, each of the beads 13 is in abutment a face 33*a* in FIG. 9 as is the case in FIG. 3, but the underside of the bar is only in abutment against face 33*b*.

It will be observed that the shape of the blade has been modified with respect to the other embodiment, since it abuts directly against the stirrup 1, the fingers 41 being eliminated. It is also noted that shaft 2, in its two pivoted positions, is in abutment against the underside of the chassis 7 and no longer against the transverse partitions 32 of the box element 3.

Concerning the median position of the stirrup 1, it is similar in FIG. 8 and in FIG. 2, the blade 4 forming a suspension for the axle as long as bar 14 remains in the slot 34.

It must, moreover, be understood that the foregoing description has been given only by way of example and that it in no way limits the domain of the invention which would not be exceeded by replacing the details of execution described by any other equivalents.

It goes without saying that the positions of the front and rear axles may be different. For example, one of them may be in high position, while the other is in low position, or vice versa.

What is claimed is:

1. A toy vehicle comprising a chassis having at least two depending lug means which are spaced apart a first distance, each of said lug means having a vertical slot which extends upwardly and is open communication with an open notch, each of said notches being defined by opposing faces, at least one axle means for supporting a pair of wheels relative to said chassis, said axle means including stirrup means having a pair of spaced and aligned bearing portions which are connected by an offset bar element, said stirrup means being mounted within said two lug means and being selectively positioned with said slots and said notches so as to adjust the height of said wheels relative to said chassis, and retaining means depending from said chassis and engaging said stirrup means to thereby retain said stirrup means against said opposing faces of said notches or within said slots.

2. The toy vehicle of claim 1 wherein each of said opposing faces of said notches are inclined upwardly and outwardly with respect to said vertical slot.

3. The toy vehicle of claim 2 in which said stirrup means abuts each of said opposing faces of said notches when said stirrup means is positioned within said notches.

4. The toy vehicle of claim 3 in which said stirrup means includes a pair of spaced bead portions whch extend from opposite ends of said bar element to said bearing portions, each of said bar element and spaced bead portions being generally coplanar with an axis taken through said bearing portions.

5. The toy vehicle of claim 4 in which said bead portions include a top surface and inwardly oriented upper and lower side walls, said upper and lower side walls of one of said bead portions being in opposing relationship to said upper and lower side walls of the other of said bead portions, said upper side walls of said bead portions being spaced apart a distance which is less than said first distance and said lower side walls being spaced apart by a distance greater than said first distance so as to extend outwardly of said lug means, each of said top surfaces of said bead portions abutting one of said opposing faces of said notches when said bar element abuts the other of said opposing faces.

6. The toy vehicle of claim 5 wherein said lug means are connected by two transverse partitions thereby forming an enclosed box element having said slots and said notches at opposite ends thereof.

7. The toy vehicle of claim 6 wherein said axle means includes a shaft supported within said bearings, said shaft engaging one of said partitions when said stirrup means is seated within said notches.

8. The toy vehicle of claim 1 wherein said notches in said lug means are formed in the shape of a diamond having two pairs of opposing tapering faces.

9. The toy vehicle of claim 8 in which said stirrup means abuts each of one of said pair of opposing faces and one of said faces of the other of said pair of opposing faces when said stirrup means is positioned within said notches.

10. The toy vehicle of claim 9 wherein said axle means includes a shaft supported within said bearings, said shaft engaging a portion of the chassis when said stirrup means is seated within said notches.

* * * * *